US008146278B1

(12) United States Patent
Grant et al.

(10) Patent No.: US 8,146,278 B1
(45) Date of Patent: Apr. 3, 2012

(54) ILLUMINATED FLAG

(76) Inventors: Melvin Grant, Mt. Olive, AL (US); Linda M. Grant, Mt. Olive, AL (US)

( * ) Notice: Subject to any disclaimer, the term of this patent is extended or adjusted under 35 U.S.C. 154(b) by 0 days.

(21) Appl. No.: 13/011,306

(22) Filed: Jan. 21, 2011

(51) Int. Cl.
*G09F 13/00* (2006.01)
*G09F 21/04* (2006.01)

(52) U.S. Cl. ..... 40/591; 40/572; 116/174

(58) Field of Classification Search ..... 40/572, 40/591, 219; 166/173, 174; 362/812
See application file for complete search history.

(56) References Cited

U.S. PATENT DOCUMENTS

| | | | | |
|---|---|---|---|---|
| 1,347,210 | A * | 7/1920 | Crick | 40/463 |
| 1,550,001 | A * | 8/1925 | Reininger | 40/572 |
| 2,280,817 | A | 4/1942 | Freeman | |
| 3,305,961 | A * | 2/1967 | Lanzon et al. | 362/486 |
| 3,762,360 | A | 10/1973 | Hawes | |
| 4,110,818 | A | 8/1978 | Hempsey | |
| 4,601,255 | A | 7/1986 | Marcotti | |
| 4,607,444 | A | 8/1986 | Foster | |
| 4,633,215 | A * | 12/1986 | Anders et al. | 340/473 |
| 4,833,443 | A | 5/1989 | Siew | |
| 5,477,437 | A | 12/1995 | Lach | |
| 5,519,595 | A | 5/1996 | Wang | |
| 5,533,289 | A | 7/1996 | Hoffman | |
| 5,881,481 | A | 3/1999 | Bashaw, Jr. et al. | |
| D422,529 | S | 4/2000 | Watts, Jr. | |
| 6,449,889 | B1 | 9/2002 | Hottenstein | |
| 6,455,767 | B1 | 9/2002 | Muller | |
| 6,732,460 | B2 | 5/2004 | Blakeslee | |
| 6,860,047 | B1 | 3/2005 | Rodriguez | |
| 7,192,168 | B2 | 3/2007 | Day | |
| 7,233,259 | B2 * | 6/2007 | Gibson et al. | 340/907 |
| D546,242 | S | 7/2007 | Strader | |
| 2002/0139024 | A1 | 10/2002 | Applebee | |
| 2003/0079392 | A1 | 5/2003 | Newman | |
| 2003/0200683 | A1 | 10/2003 | Gailen | |
| 2006/0023446 | A1 | 2/2006 | Racoosin | |
| 2007/0089338 | A1 | 4/2007 | Barnhouse et al. | |
| 2008/0104870 | A1 | 5/2008 | Alden | |

* cited by examiner

*Primary Examiner* — Casandra Davis
(74) *Attorney, Agent, or Firm* — C. Brandon Browning; Maynard Cooper + Gale, PC

(57) ABSTRACT

An illuminated display configured for mounting to an automobile flag pole, or alternatively, to a window, the display including a rectangular enclosure having a transparent first side, a transparent second side, a bottom side, opposing lateral sides and a hinged-top lid. An interchangeable first panel displaying a first indicia, an interchangeable second panel displaying a second indicia and an opaque middle panel having a light source coupled to each side thereof are supported within the enclosure by sets of opposing tracks extending along the interior surface of the enclosure.

19 Claims, 5 Drawing Sheets

ILLUMINATED FLAG

FIELD OF THE INVENTION

The present invention relates to an illuminated flag, and more particularly to a display assembly that is attachable to a vehicle flag pole, the display assembly being illuminated and having interchangeable panels for displaying desired indicia.

BACKGROUND OF THE INVENTION

Illuminated automobile flags and displays are known in the art. For example, U.S. Patent Application Publication No. 2008/0104870 A1 discloses a wind powered car flag bearing an indicia such as a team logo. The car flag includes a first printed substrate which is a thin flexible translucent substrate that is colored to provide a first indicia and s second printed substrate which is a thin flexible translucent substrate that is colored to provide a second indicia. The first printed substrate faces in a first direction to be readable from a first side and the second printed substrate faces in a second direction to be readable from a second side. Sandwiched between the first printed substrate and the second printed substrate is a circuit substrate which is a thin transparent flexible material such as fabric or plastic onto which is affixed a plurality of LEDs. The LEDs are white or another suitable color to illuminate the logo and indicia of a specific message. The LEDs are electrically connected in series and to a generator. During assembly, the first printed substrate, the circuit substrate, and the second printed substrate are sewed together to form a flag including LED illumination lights in the middle layer between the two printed substrates and affixed in a predetermined position relative to the indicia on the printed substrates. A connecting substrate is a fabric material which is sewed to the flag in a sleeve like configuration such that it can be slipped over an adhering substrate to adhere the flag thereto.

U.S. Pat. No. 6,449,889 discloses a vehicle lighted display device including a pair of spaced apart panes defining an opening along upper edges thereof; a frame member about the panes having opposed side walls and a bottom wall extending longitudinally between the side walls for holding the panes; an indicia sheet positioned between the panes and adapted to be inserted or removed through the opening; and a plurality of light assemblies spaced apart along the side walls. Each light assembly includes a cylindrical housing integrally extending through a respective side wall of the frame member and having a front portion and a rear portion; a light bulb disposed in the front portion; a magnet disposed in the rear portion for removably coupling the frame member to a metallic surface; a battery disposed in the rear portion; and means in the rear portion for moving the battery between a first position displaced from the light bulb when the frame member is not magnetically coupled to the metallic surface and a second position electrically connected to the light bulb when the frame member is magnetically coupled to the metallic surface, whereby the light bulb is energized when the frame member is magnetically coupled to the metallic surface.

U.S. Pat. No. 6,860,047 discloses an illuminated flag decal including a generally rectangular frame having a continuous transparent front face and an opaque back face. The frame defines an exterior and an interior wherein the interior is bounded by the frame around a perimeter, the front face and the back face. The continuous transparent front face defines an unimpeded visual area and a bordering perimeter. The decal further includes a plurality of suction cups for securing the generally rectangular frame to supporting surface, the plurality of suction cups being mounted in predetermined arrangement about the bordering perimeter of the exterior of the front face. The back face includes a removable backing for accessing the interior of the frame. At least one translucent flag is removably disposed on the interior of the unimpeded visual area of the front face. An illumination source is mounted on the interior of the frame between the front face and the back face, the illumination source illuminating the at least one translucent flag.

SUMMARY OF THE INVENTION

The present invention is directed to an illuminated display configured for mounting to an automobile flag pole, or alternatively, to a window. The display includes a rectangular enclosure having a transparent first side, a transparent second side, a bottom side, opposing lateral sides, and a hinged-top lid. Each interior face of the opposing lateral sides includes three vertically extending guide slots which are aligned with the guide slots of the opposing interior face to provide three sets of aligned guide slots. Each of the three sets of aligned guide slots is arranged to receive a removable panel. Specifically, a center set of aligned guide slots is arranged to receive an opaque panel having a string of LEDs coupled to each side thereof. A first and a second set of aligned guide slots, one of which is arranged on either side of the center set of aligned guide slots, are arranged to receive removable display panels.

The display panels can include any number of indicia including messages or logos. The panels include opaque and transparent portions with the light emitted by the LEDs being visible through the transparent portions thus creating the desired indicia. The panels are accessible and removable through the top lid which is directly coupled to a top edge of one of the lateral sides. To power the LEDs, a rechargeable battery is situated within the enclosure. Also provided are 110 V and 12 V power adapters which can be connected to the LEDs and battery. The enclosure is detachably coupled to the automobile flag pole by any number of means known in the art, for example, by a set of connecting rings. To couple the enclosure to a window, a set of four suctions cups is provided.

DETAILED DESCRIPTION OF PRESENTLY PREFERRED EMBODIMENTS

Figure 1:
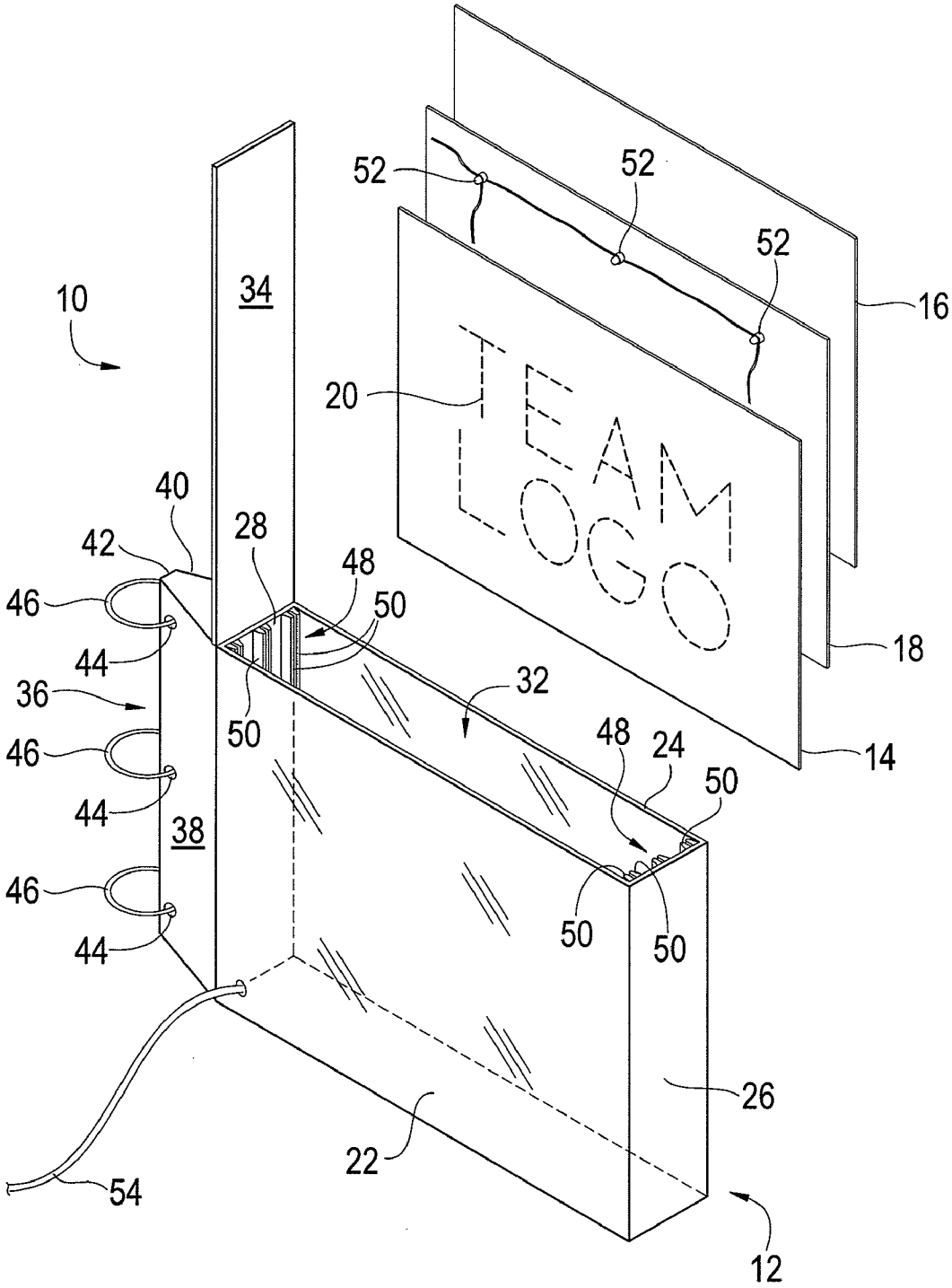
FIG. 1 is an exploded view of an illuminated display in accordance with a preferred embodiment of the present invention.

FIGS. 1 through 5 depict an illuminated display 10 in accordance with a preferred embodiment of the present invention. Generally, display 10 includes a rigid, plastic enclosure 12 configured for supporting a pair of removable transparent viewing panels 14 and 16 and a single, opaque lighting panel 18 therebetween. Each of viewing panels 14 and 16 includes a desired, opaque indicia 20 which is illuminated by lighting panel 18 and viewable through enclosure 12. Illuminated display 10 can be affixed to any substantially flat surface using suction cups or the like or to a pole such a flag pole. In its preferred embodiment, illuminated display 10 is configured for attaching to an automobile window flag pole.

Figure 2:
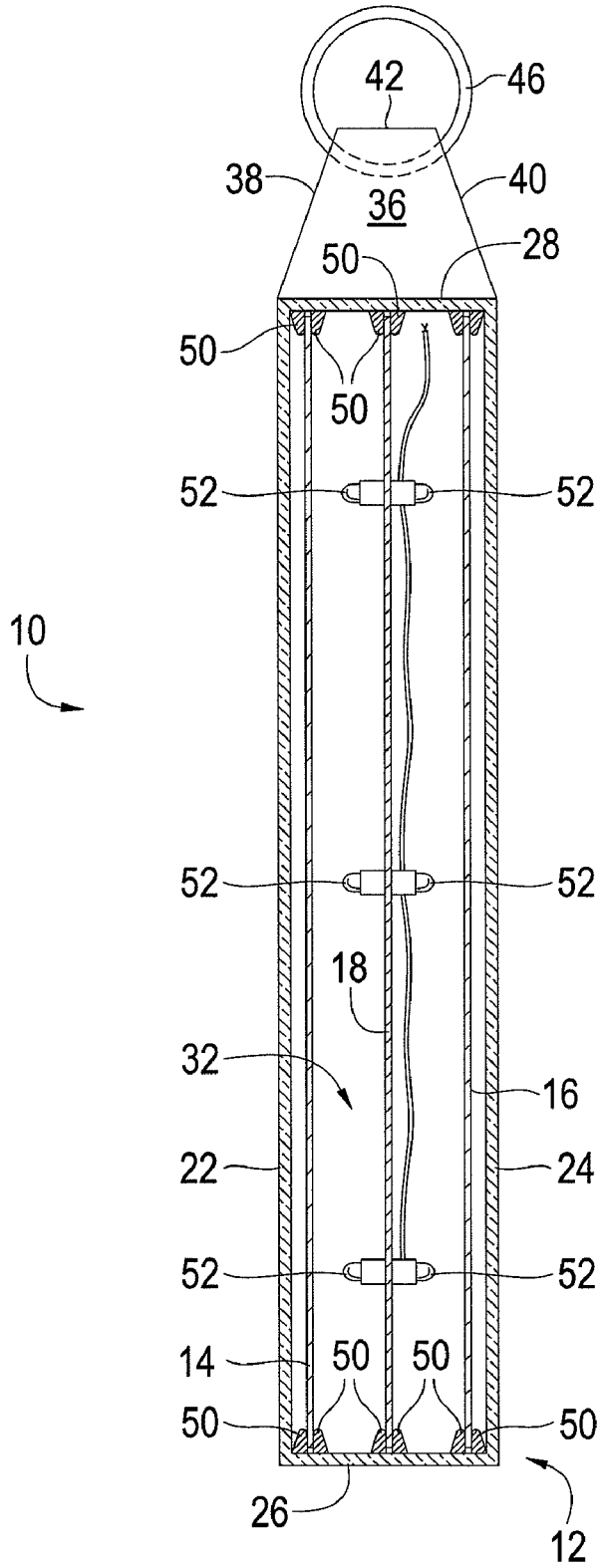
FIG. 2 is a top plan view of the illuminated display with a top side of the display removed.
Figure 3:
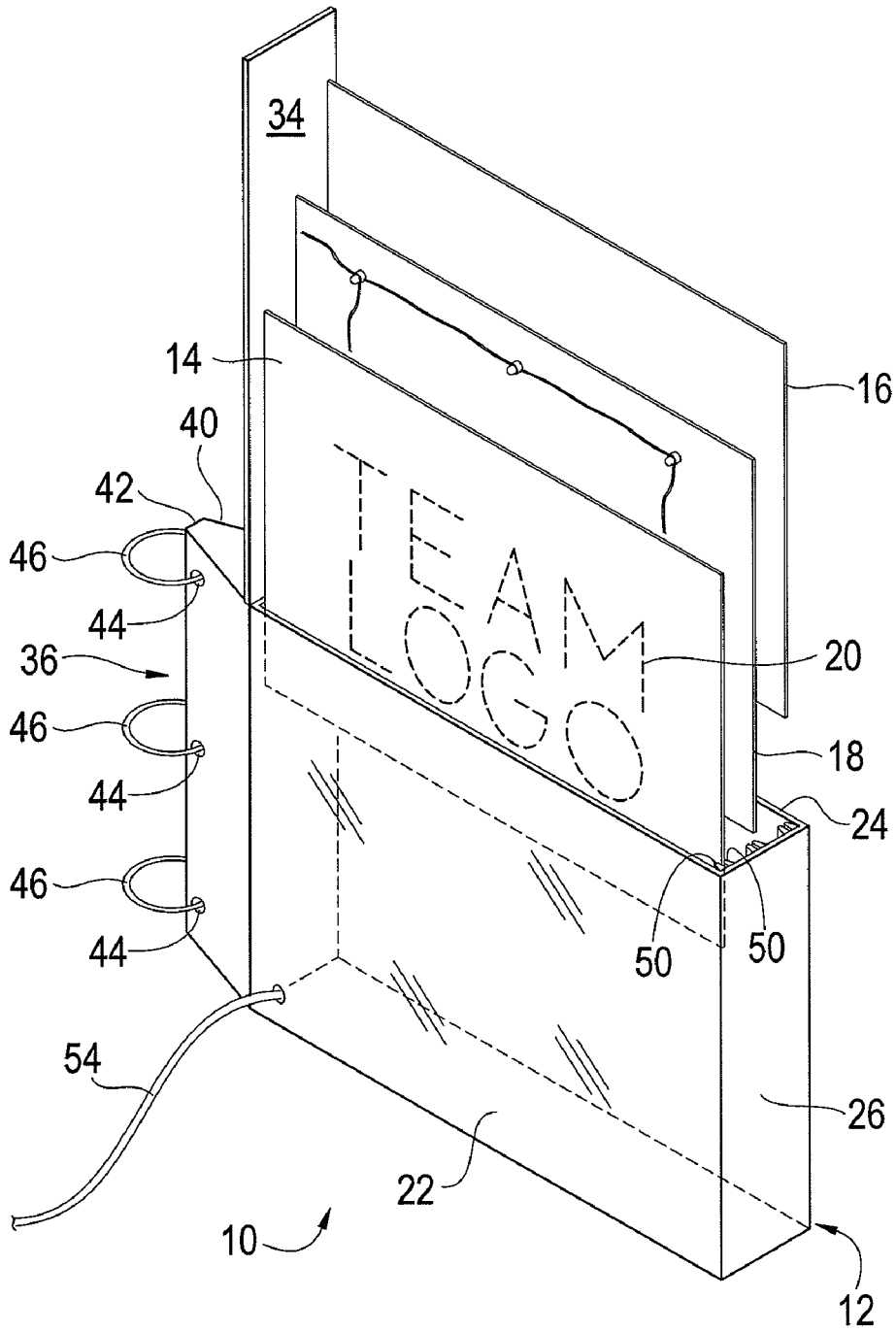
FIG. 3 is a perspective view of the illuminated display showing insertion of a pair of display panels and a light panel into the display.
Figure 4:
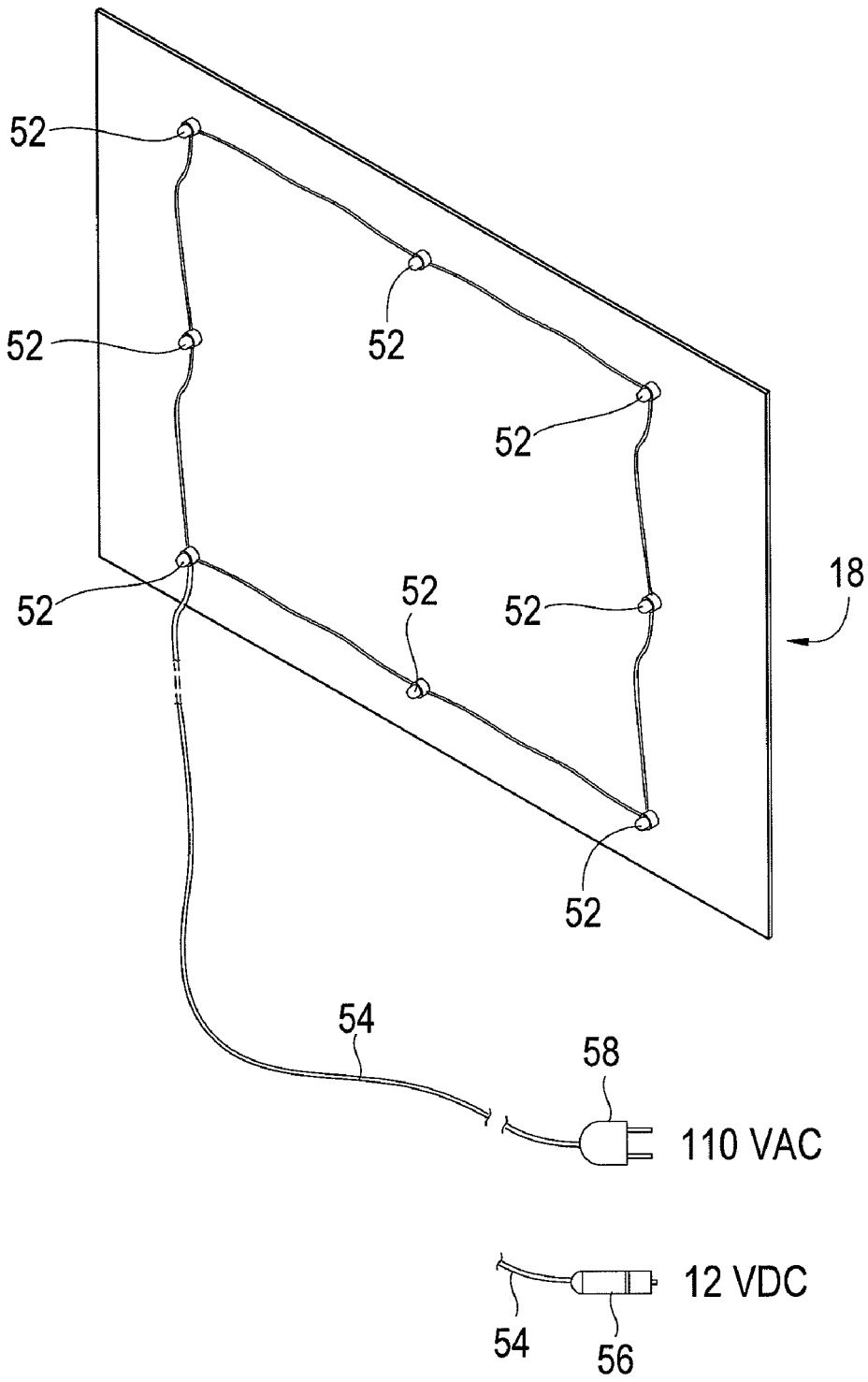
FIG. 4 is a perspective view of the light panel of FIG. 3 and a power source for the light panel.

More particularly, referring to FIGS. 1 through 3, enclosure 12 is composed of two, opposing transparent walls 22 and 24 joined along respective bottom and lateral edges by a pair of opaque opposing lateral walls 26 and 28 and along their respective bottom edges by an opaque bottom wall 30. Together, walls 22, 24, 26, 28 and 30 form a rectangular chamber 32 having an open top. The open top provides access into chamber 32 allowing panel access to and removal of panels 14, 16 and 18 from chamber 32 when required. A lid 34 is hingedly coupled to the top edge of lateral wall 28 for enclosing chamber 32 and maintaining panels 14, 16 and 18 therein. Lid 34 can be fixed in a closed position utilizing any means known in the art.

To assist with coupling of enclosure 12 to an automobile flag pole 11, enclosure 12 includes a tapered portion 36 that extends outwardly from the respective lateral edges of viewing panels 22 and 24 along their junction with lateral panel 28. Tapered portion 36 includes sides 38 and 40 which are coupled together by a flat side 42. A number of holes 44 extend through sides 38 and 48 which are provided for receiving a complimentary number of rings 46 for connecting enclosure 12 to flag pole 11. Tapered portion 36 also serves to decrease wind resistance against enclosure 12 as it is carried on a moving automobile.

To support panels 14, 16 and 18 within chamber 32 of enclosure 12, lateral walls 26 and 28 include three pairs of elongate, opposing channels 48 that extend vertically between bottom wall 30 and the open top of enclosure 12. Each of channels 48 is defined by a pair of pliable, opposed, spaced ribs 50 which extend along a respective lateral panel 26, 28. Aligned with each channel 48 is an opposing channel 48 supported on the opposing lateral wall. This way, each of panels 14, 16 and 18 can be removably supported within enclosure 12 by inserting a panel into opposing channels 48.

Panels 14 and 16 provide a structure upon which indicia 20 can be supported. In the preferred embodiment, indicia 20 is opaque and the remainder of panels 14 and 16 are transparent. Pursuant to this configuration, the light created by lighting panel 18 is visible through panels 14 and 16 and around indicia 20. However, it is contemplated that indicia 20 can be transparent while the remaining portions of panels 14 and 16 are opaque. In this configuration, the light emitted by lighting panel 18 is seen through indicia 20 only. Further, there is no requirement that indicia 20 on one panel be the same as the indicia on the other panel. Thus, display 10 can be used to communicate a message on one side that is different from the message communicated on the other side. If ever it is desired to change indicia 20, panels 14 and 16 can be easily removed from chamber 32 through the open top of enclosure 12 by sliding panels 14 and 16 upwardly through the open top and replacing them with panels having different indicia.

To illuminate indicia 20 lighting panel 18 is provided. In particular, lighting panel 18 is constructed of an opaque, plastic having a number of electrically interconnected lights 52 supported thereon. When electrified, lights 52 fill the areas of chamber 32 between lighting panel 18 and each of viewing panels 14 and 16 with light that is emitted through the transparent portions of panels 14 and 18 and transparent walls 22 and 24 of enclosure 12 thus enabling viewing of indicia 20. In the preferred embodiment, lights 52 are coupled by a wire 54 to a 12 volt DC adapter 56 so that lights 52 are powered by an automobile to which display 12 is coupled. Alternatively, wire 54 can be coupled to a 110 volt AC adapter 58 so that lights 52 can be powered by a standard home outlet, for example, if display 12 were coupled to the inside surface of an exterior window. In another embodiment, lights 52 can be powered by a battery (not shown) stored within enclosure 12 and accessible through a hatch 60 in bottom wall 30.

Figure 5:
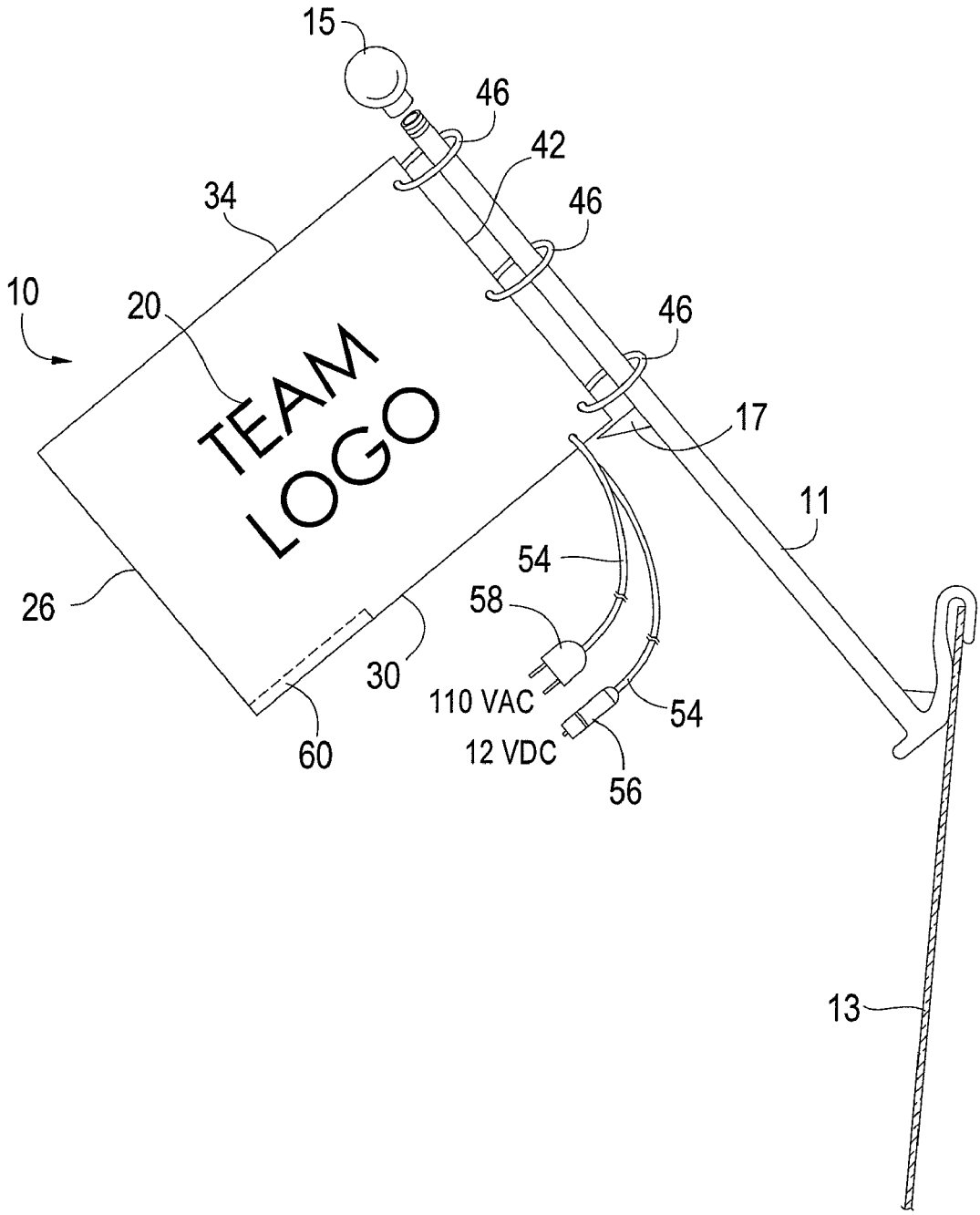
FIG. 5 is an elevational view of the illuminated display of FIG. 1 coupled to an automobile window.

Referring to FIG. 5 there is depicted display 10 coupled to automobile flag pole 11. Display 10 is supported on pole 11 by removing a top 17 from flag 11 and inserting pole 11 through rings 46 so that display 10 can rest on a stop 17. In conventional fashion, pole 11 is secured to the upper edge of an automobile window 13 and adapter 56 is extended above the window and into the automobile where it is plugged into a cigarette lighter or the like.

Modifications and other embodiments of the invention will be apparent to those skilled in the art to which this invention relates having the benefit of the foregoing teachings, descriptions and drawings the present invention is not limited to the specific embodiments disclosed, but is to include modifications and other embodiments which are within the scope of the appended claims.

It is claimed:

1. A display comprising, an enclosure having a transparent first side, a transparent second side opposite the first side, a bottom side, a first lateral side, a second lateral side and a lid arranged for providing access into the enclosure, a pole having a bottom end configured for coupling to an edge of an automobile window and an upper portion detachably coupled to the first lateral side of the enclosure, an interchangeable first panel displaying a first indicia, an interchangeable second panel displaying a second indicia and an opaque middle panel having a light source coupled to each side thereof, each of the first panel, the second panel and the middle panel being removably supported within the enclosure, a first panel support supporting the first panel within the enclosure adjacent to the first side, a second panel support supporting the second panel within the enclosure adjacent to the second side, a middle panel support supporting the middle panel between the first panel and the second panel, and a power source coupled to the light source.

2. The display according to claim 1 wherein the first lateral side has a substantially V-shaped or U-shaped cross-section.

3. The display according to claim 1 wherein the lid is hingedly coupled to a top edge of the enclosure.

4. The display according to claim 1 wherein at least one of the first panel support, the second panel support and the middle panel support includes a first track extending vertically within the enclosure along the first lateral side and a second track extending vertically within the enclosure along the second lateral side, the first track and the second track being aligned.

5. The display according to claim 4 wherein the enclosure is constructed of rigid plastic, the first lateral side has a substantially V-shaped or U-shaped cross-section, the lid is hingedly coupled to a top edge of the enclosure, the bottom end of the pole is coupled to an edge of an automobile window, and the power source includes at least one of a battery contained within the enclosure, a 12 volt adapter and a 110 volt adapter.

6. The display according to claim 1 wherein the bottom end of the pole is coupled to an edge of an automobile window.

7. The display according to claim 1 wherein the power source includes at least one of a battery contained within the enclosure, a 12 volt adapter and a 110 volt adapter.

8. The display according to claim 1 wherein the enclosure is constructed of rigid plastic.

9. A display comprising, a rigid, plastic enclosure having a transparent first side, a transparent second side opposite the first side, a bottom side, a top side, a first lateral side, a second lateral side and an interior surface, a pole having a bottom end configured for coupling to an edge of an automobile window and an upper portion coupled to the enclosure, an interchangeable first panel displaying a first indicia, an interchangeable second panel displaying a second indicia and an opaque middle panel having a light source coupled to each side thereof, each of the first panel and the second panel being removably supported within the enclosure, a first panel support supporting the first panel within the enclosure substantially parallel to the first side, a second panel support supporting the second panel within the enclosure substantially parallel to the second side, and a power source coupled to the light source, wherein the first panel support includes a first set of opposing tracks extending along the interior surface of the enclosure and the second panel support includes a second set of opposing tracks extending along the interior surface of the enclosure.

10. The display according to claim 9 wherein the bottom end of the pole is coupled to an automobile window.

11. The display according to claim 9 wherein each of the first set of opposing tracks and the second set of opposing tracks extend along the first lateral side and the second lateral side of the enclosure.

12. The display according to claim 9 further comprising a middle set of opposing tracks into which the middle panel is removably received.

13. The display according to claim 9 wherein the top side is at least partially removable from the enclosure for providing access into the enclosure.

14. A display kit comprising, a rigid, plastic enclosure having a transparent first side, a transparent second side opposite the first side, a bottom side, a top side, a first lateral side, a second lateral side and an interior surface, a pole having a bottom end configured for coupling to an edge of an automobile window and an upper portion configured for detachably coupling to the enclosure, an interchangeable first panel displaying a first indicia, an interchangeable second panel displaying a second indicia and an opaque middle panel having a light source coupled to each side thereof, a first panel support configured for supporting the first panel within the enclosure adjacent to the first side, a second panel support configured for supporting the second panel within the enclosure adjacent to the second side, and a power source configured for powering the light source, wherein the first panel support includes a first set of opposing tracks extending along the interior surface of the enclosure and the second panel support includes a second set of opposing tracks extending along the interior surface of the enclosure.

15. The display kit according to claim 14 wherein each of the first set of opposing tracks and the second set of opposing tracks extend along the first lateral side and the second lateral side of the enclosure.

16. The display kit according to claim 15 further comprising a middle set of opposing tracks into which the middle panel is removably received.

17. The display kit according to claim 15 wherein the top side is at least partially removable from the enclosure for providing access into the enclosure.

18. The display kit according to claim 15 wherein the power source includes at least one of a battery contained within the enclosure, a 12 volt adapter and a 110 volt adapter.

19. The display kit according to claim 15 further comprising a set of suction cups configured for coupling the first side of the enclosure to a window.

* * * * *